US010410620B1

(12) United States Patent
Hein et al.

(10) Patent No.: US 10,410,620 B1
(45) Date of Patent: Sep. 10, 2019

(54) SYSTEMS AND METHODS FOR REDUCING ACOUSTIC ARTIFACTS IN AN ADAPTIVE FEEDFORWARD CONTROL SYSTEM

(71) Applicant: Bose Corporation, Framingham, MA (US)

(72) Inventors: Travis Hein, Holliston, MA (US); Siamak Farahbakhsh, Waltham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/119,745

(22) Filed: Aug. 31, 2018

(51) Int. Cl.
*G10K 11/178* (2006.01)

(52) U.S. Cl.
CPC .. *G10K 11/17853* (2018.01); *G10K 11/17823* (2018.01); *G10K 2210/1282* (2013.01); *G10K 2210/3011* (2013.01); *G10K 2210/3028* (2013.01); *G10K 2210/501* (2013.01)

(58) Field of Classification Search
USPC ..... 381/71.1, 71.2, 71.4, 71.11, 71.12, 71.7, 381/71.8, 365
See application file for complete search history.

(56) References Cited

U.S. PATENT DOCUMENTS 7,340,064 B2 3/2008 Onishi et al.
7,885,417 B2 2/2011 Christoph
8,077,873 B2 12/2011 Shridhar et al.
8,135,140 B2 3/2012 Shridhar et al.
8,189,799 B2 5/2012 Shridhar et al.
8,199,923 B2 6/2012 Christoph
8,199,924 B2 6/2012 Wertz et al.
(Continued)

FOREIGN PATENT DOCUMENTS

CN 104952442 9/2015
EP 1414021 5/2008
(Continued)

OTHER PUBLICATIONS

Roure et al., The Remote Microphone Technique for Active Noise Control, Proceedings of Active 99, Dec. 1999, ISSN 0-9622072-2-5, pp. 1233-1244.
(Continued)

*Primary Examiner* — Yosef K Laekemariam
(74) *Attorney, Agent, or Firm* — Bond, Schoeneck & King, PLLC

(57) ABSTRACT

A system and method for reducing or eliminating undesirable acoustic artifacts when a vehicle is struck by road debris. The method includes generating a noise signal representative of a first acceleration detected by an accelerometer of a vehicle caused by a disturbance and generating a noise-cancellation signal via a controller within the vehicle. Residual noise resulting from the combination of the acoustic energy of the noise-cancellation signal and the disturbance is detected by a reference sensor, which generates a reference sensor signal based on the residual noise. The reference sensor signal is transmitted to an adaptive processing module to adapt filter coefficients. A second acceleration is detected by the accelerometer and a level detector calculates the absolute value of a derivative of the second acceleration. If the absolute value exceeds a threshold value, adjustment of the filter coefficients is prevented.

20 Claims, 2 Drawing Sheets

(56) References Cited

U.S. PATENT DOCUMENTS

| | | | |
|---|---|---|---|
| 8,270,626 | B2 | 9/2012 | Shridhar et al. |
| 8,315,404 | B2 | 11/2012 | Shridhar et al. |
| 8,559,648 | B2 | 10/2013 | Christoph |
| 8,565,443 | B2 | 10/2013 | Wurm |
| 8,644,521 | B2 | 2/2014 | Christoph et al. |
| 8,718,289 | B2 | 5/2014 | Shridhar et al. |
| 8,848,937 | B2 | 9/2014 | Inoue et al. |
| 9,020,158 | B2 | 4/2015 | Wertz et al. |
| 9,042,569 | B2 | 5/2015 | Sakamoto et al. |
| 9,153,226 | B2 | 10/2015 | Wurm |
| 9,431,001 | B2 | 8/2016 | Cherkassky et al. |
| 9,445,192 | B2 | 9/2016 | Ueno et al. |
| 9,478,209 | B2 | 10/2016 | Wurm |
| 9,596,540 | B2 | 3/2017 | Tani et al. |
| 9,646,596 | B2 | 5/2017 | Tani et al. |
| 9,870,763 | B1 | 1/2018 | Christian |
| 2016/0314778 | A1 | 10/2016 | Christoph et al. |
| 2017/0076711 | A1 | 3/2017 | Christoph et al. |
| 2017/0076712 | A1 | 3/2017 | Christoph |
| 2017/0110108 | A1 | 4/2017 | Christoph et al. |
| 2017/0178617 | A1 | 6/2017 | Christoph et al. |
| 2017/0330551 | A1 | 11/2017 | Zafeiropoulos |

FOREIGN PATENT DOCUMENTS

| | | | | |
|---|---|---|---|---|
| EP | 2375408 | | 10/2011 | |
| EP | 3 147 896 | * | 9/2015 | ..... G10K 11/178 |
| EP | 3 156 998 | * | 10/2015 | ..... G10K 11/178 |
| EP | 3147896 | | 3/2017 | |
| EP | 3156998 | | 4/2017 | |
| EP | 3157000 | | 4/2017 | |
| EP | 3157001 | | 4/2017 | |
| EP | 3159891 | | 8/2018 | |

OTHER PUBLICATIONS

Moreau et al., A Review of Virtual Sensing Algorithms for Active Noise Control, Algorithms, 2008, 1, 69-99; DOI: 10.3390/a1020069, ISSN 1999-4893, pp. 69-99.

Oh et. al., Development of Mass Producible ANC System for Broad-Band Road Noise, SAE Technical Paper 2018-01-1561, Jun. 13, 2018, doi:10.4271/2018-01-1561, pp. 1-5.

* cited by examiner

SYSTEMS AND METHODS FOR REDUCING ACOUSTIC ARTIFACTS IN AN ADAPTIVE FEEDFORWARD CONTROL SYSTEM

BACKGROUND

The present disclosure generally relates to noise control in a vehicle cabin and, more particularly, to systems and methods for reducing or entirely eliminating undesirable acoustic artifacts in an adaptive feedforward control system when a vehicle is struck by road debris.

SUMMARY

All examples and features mentioned below can be combined in any technically possible way.

In one aspect, a noise-cancellation system is provided. The noise-cancellation system includes an accelerometer arranged and configured to detect acceleration indicative of a disturbance. The accelerometer is also arranged and configured to generate a noise signal indicative of the disturbance when an absolute value of a derivative of the acceleration exceeds a threshold value. The system also includes a controller arranged and configured to generate a noise-cancellation signal and transmit the noise-cancellation signal to a speaker. The speaker transduces the noise-cancellation signal to acoustic energy. A level detector on the accelerometer is arranged and configured to receive the noise signal, calculate the absolute value of the derivative of the acceleration indicative of the disturbance, determine if the absolute value exceeds the threshold value, and set the noise signal to a zero value if the absolute value exceeds the threshold value. The system also includes a reference sensor which is arranged and configured to detect residual noise resulting from the combination of the acoustic energy of the noise-cancellation signal and the disturbance. The reference sensor is also arranged and configured to generate a reference sensor signal based on the detection of residual noise. An adaptive processing module of the system is configured to receive the reference sensor signal and the noise signal, and generate a filter update, wherein the filter update signal is set to a zero value if the absolute value meets or exceeds the threshold value. An adaptive filter of the system has one or more filter coefficients. The adaptive filter is configured to receive the filter update signal and adjust the one or more filter coefficients based on the filter update signal if the filter update signal exceeds a zero value.

In one example, the noise signal is not transmitted from the level detector to the adaptive processing module when the absolute value of the derivative of the acceleration exceeds the threshold value.

In one example, the accelerometer comprises a first axis, a second axis, and a third axis. In another example, the level detector is arranged and configured to calculate the absolute value of the derivative of the acceleration indicative of the disturbance for each of the first axis, second axis, and third axis and determine if the absolute value exceeds the threshold value for each of the first axis, second axis, and third axis. In yet another example, the noise signal is set to a zero value when the absolute value of the derivative of the acceleration of the first axis of the accelerometer exceeds the threshold value.

In one example, the accelerometer is mounted to a vehicle.

In another example, the level detector is also arranged and configured to detect a threshold level of saturation of the accelerometer. In yet another example, the noise signal is set to a zero value when saturation of the accelerometer exceeds the threshold level of saturation.

Another aspect features one or more machine-readable storage devices having encoded thereon computer readable instructions for causing one or more processors to perform operations including transmitting a noise-cancellation signal to a speaker, wherein the speaker transduces the noise-cancellation signal to acoustic energy; receiving an acceleration of a structure having a predefined volume; calculating an absolute value of a derivative of the acceleration; comparing the absolute value to a threshold value; adjusting one or more filter coefficients of an adaptive filter when the absolute value does not exceed the threshold value, wherein the one or more filter coefficients of the adaptive filter are used to filter a reference sensor signal based on residual noise, and wherein the residual noise results from the combination of acoustic energy of each of the noise-cancellation signal and an undesired noise in the predefined volume; and preventing adjustment of one or more filter coefficients of the adaptive filter when the absolute value exceeds the threshold value.

In one example, the operations also include detecting a saturation level of an accelerometer. In another example, the operations also include comparing the saturation level of the accelerometer to a threshold level of saturation. In yet another example, the operations also include preventing adjustment of one or more filter coefficients of the adaptive filter when the saturation level of the accelerometer exceeds the threshold level of saturation.

In one example, the acceleration includes an acceleration for a first axis, a second axis, and a third axis. In another example, the operations also include calculating the absolute value of the derivative of the acceleration for each of the first axis, the second axis, and the third axis.

In another aspect, a method is provided for reducing acoustic artifacts in a vehicle cabin. The method includes the steps of generating a first noise signal representative of a first acceleration detected by an accelerometer of a vehicle caused by a disturbance; generating a noise-cancellation signal via a controller within the vehicle; transmitting the noise-cancellation signal to a speaker within the vehicle, wherein the speaker transduces the noise-cancellation signal to acoustic energy emitted into the vehicle cabin; detecting residual noise via a reference sensor in the vehicle cabin; wherein the residual noise results from the combination of the acoustic energy of the noise-cancellation signal and the disturbance; generating a reference sensor signal via the reference sensor based on the residual noise; receiving the reference sensor signal and the first noise signal at an adaptive processing module of the controller; generating a filter update signal via the adaptive processing module based on the reference sensor signal and the first noise signal; adjusting one or more filter coefficients of an adaptive filter of the controller based on the filter update signal; detecting a second acceleration with the accelerometer; calculating an absolute value of a derivative of the second acceleration using a level detector at the controller; comparing, via the level detector, the absolute value to a threshold value; and preventing adjustment of one or more filter coefficients of the adaptive filter of the controller based on the filter update signal when the absolute value exceeds the threshold value.

In one example, the method includes the steps of generating a second noise signal representative of the second acceleration and setting the second noise signal to a zero value when the absolute value exceeds the threshold value.

In another example, the method includes the steps of detecting, via the level detector, a saturation level of the accelerometer; and comparing, via the level detector, the saturation level of the accelerometer to a threshold value of saturation. In yet another example, the method includes the step of preventing adjustment of one or more filter coefficients of the adaptive filter of the controller based on the filter update signal when the saturation level of the accelerometer exceeds the threshold value of saturation.

In one example, the accelerometer has a plurality of axes. In another example, the method includes the step of step of detecting a second acceleration with the accelerometer comprises the step of detecting a second acceleration of each of the plurality of axes of the accelerometer.

The details of one or more implementations are set forth in the accompanying drawings and the description below. Other features, objects, and advantages will be apparent from the description and the drawings, and from the claims.

DETAILED DESCRIPTION

The present disclosure describes various systems and methods for reducing or entirely eliminating undesirable acoustic artifacts when a vehicle is struck by road debris.

Figure 1:
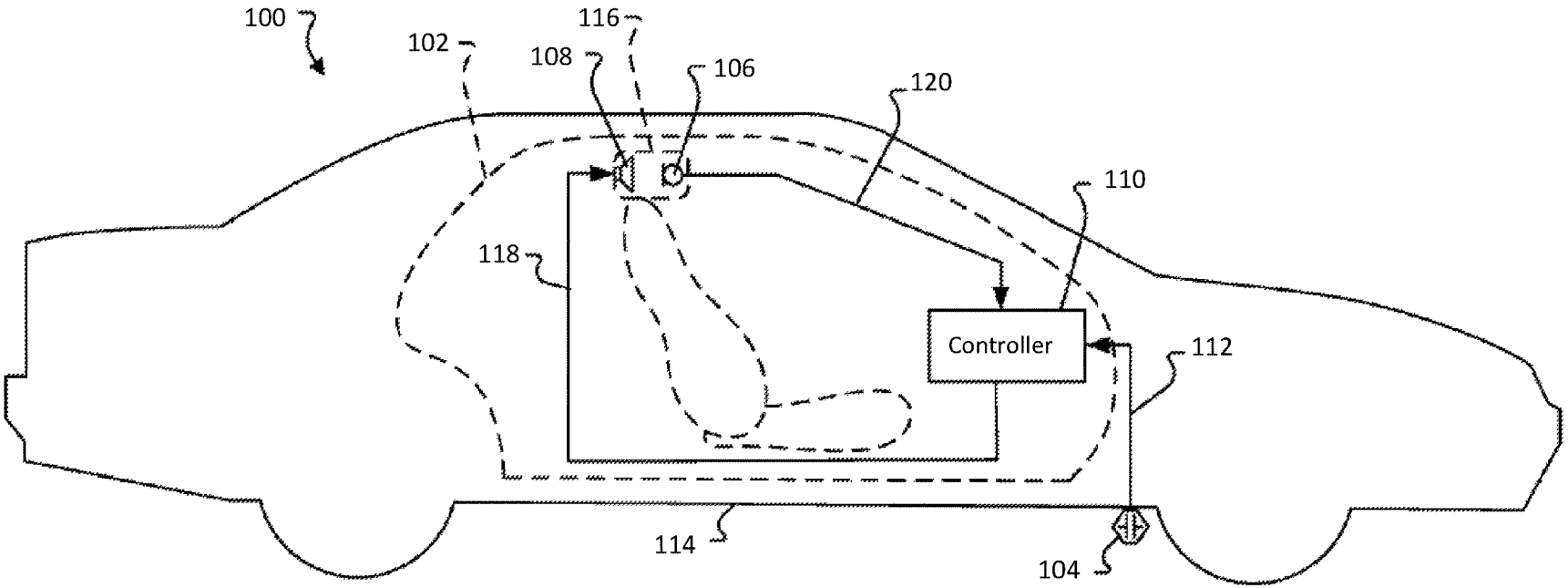
FIG. 1 is a diagram of the noise-cancellation system in a vehicle cabin.

Referring now to the figures, wherein like reference numerals refer to like parts throughout, FIG. 1, is a schematic view of noise-cancellation system 100. Noise-cancellation system 100 is configured to destructively interfere with undesired sound in at least one cancellation zone within a predefined volume such as a vehicle cabin 102. In an embodiment, the undesired sound is within a predetermined frequency range (e.g., frequencies less than approximately 350 Hz). At a high level, in an embodiment, the noise-cancellation system 100 includes a noise sensor 104, a reference sensor 106, a speaker 108, and a controller 110.

In an embodiment, the noise sensor 104 is configured to generate noise signal(s) 112 representative of the undesired sound, or a source of the undesired sound, within a predefined volume 102. For example, the noise sensor 104 may be an accelerometer mounted to and configured to detect vibrations transmitted through a vehicle structure or body 114. Vibrations transmitted through the vehicle structure 114 are transduced by the structure 114 into undesired sound in the vehicle cabin 102 (perceived as a road noise). Thus, an accelerometer 104 mounted to the structure 114, as shown in FIG. 1, provides a noise signal 112 representative of the undesired sound to the controller 110.

Speakers 108 (or any other electro-acoustic transducer) may, for example, be distributed in discrete locations about the perimeter of the predefined volume 102. In an example, four or more speakers 108 may be disposed within a vehicle cabin 102, each of the four speakers 108 being located within a respective door of the vehicle 114 and configured project sound into the vehicle cabin 102. In the exemplary embodiment shown in FIG. 1, a speaker 108 is located within a headrest 116 in the vehicle cabin 102.

A command signal—referred to in this application as a noise-cancellation signal 118—may be generated by the controller 110 and provided to one or more speakers 108 in the predefined volume 102. The speakers 108 transduce the noise-cancellation signal 118 to acoustic energy (i.e., sound waves). The acoustic energy produced as a result of noise-cancellation signal 118, is approximately 180° out of phase with—and thus destructively interferes with—the undesired sound within the vehicle cabin 102. The combination of sound waves generated from the noise-cancellation signal 118 and the undesired noise in the predefined volume 102 results in cancellation of the undesired noise, as perceived by a listener in the predefined volume 102.

Reference sensors 106, disposed within the predefined volume 102, generate a reference sensor signal 120 based on detection of residual noise resulting from the combination of the sound waves generated from the noise-cancellation signal 118 and the undesired sound in the predefined volume 102. The reference sensor signal 120 is provided to the controller 110 as feedback. Because the reference sensor signal 120 will represent residual noise, uncancelled by the noise-cancellation signal 120, the reference sensor signal 120 may be understood as an error signal. Reference sensors 106 may be, for example, at least one microphone mounted within a vehicle cabin 102 (e.g., in the roof, headrests 116, pillars, or elsewhere within the cabin 102).

In an embodiment, the controller 110 may comprise a non-transitory storage medium and processor. In an embodiment, the non-transitory storage medium may store program code that, when executed by processor, implements the filter 122 described in connection with FIG. 2. The controller 110 may be implemented in hardware and/or software. For example, the controller 110 may be implemented by an FPGA, an ASIC, or other suitable hardware.

Figure 2:
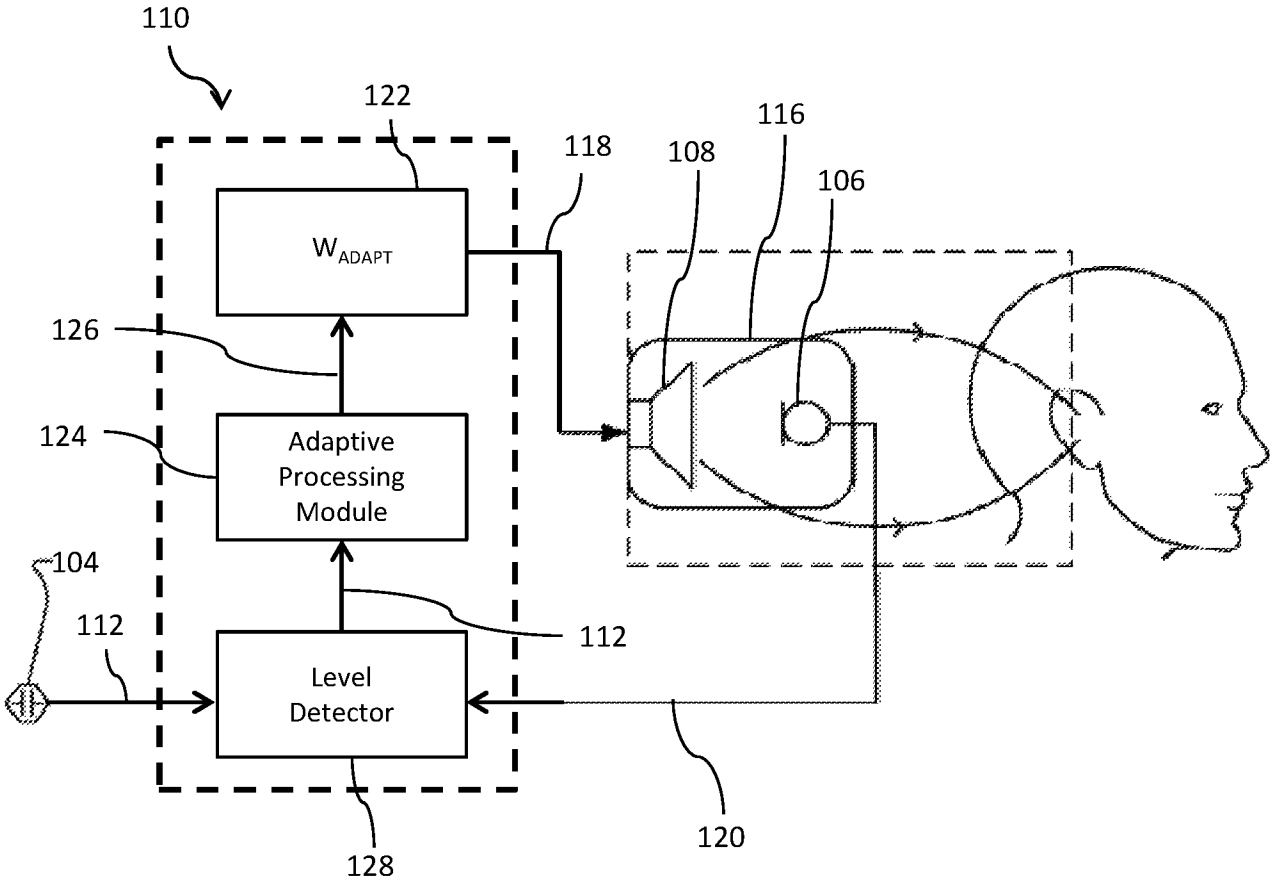
FIG. 2 is a block diagram of the controller of FIG. 1.

Turning to FIG. 2, there is a block diagram of noise-cancellation system 100, including an adaptive filter 122 implemented by the controller 110. As shown, the controller 110 may define a control system including filter $W_{ADAPT}$ 122 and an adaptive processing module 124. The adaptive processing module 124 receives, as inputs, the reference sensor signal 120 and the noise signal 112 and, using those inputs, generates a filter update signal 126. The filter update signal 126 is an update to the filter coefficients implemented in filter $W_{ADAPT}$ 122. Thus, the noise-cancellation system 100 executes adaptations or changes in a filter coefficient in a continuous, sample by sample process when a vehicle 114 is in operation.

Filter $W_{ADAPT}$ 122 is configured to receive the filter update signal 126 and the noise signal 112 as inputs and to generate noise-cancellation signal 118 based on filter coefficients that may have been updated in accordance with the filter update signal 126. The noise-cancellation signal 118, as described above, is input to speakers 108 where it is transduced into the noise-cancellation audio signal that destructively interferes with the undesired sound in a cancellation zone. Filter $W_{ADAPT}$ 122 may be implemented as any suitable linear filter. For example, filter $W_{ADAPT}$ 122 may be a multi-input multi-output (MIMO) finite impulse response (FIR) filter.

When the vehicle 114 is operating, one or more noise sensors 104 (hereinafter referred to as accelerometers 104) positioned on and mounted to the exterior of the vehicle structure 114 measure the road acceleration of the vehicle 114. In an embodiment, each accelerometer 104 has 3 axes. When road debris, such as a rock, is projected near or directly at one of the accelerometers 104, the rock excites or otherwise affects that accelerometer 104. Road debris is typically projected at or near the accelerometers 104 when the road debris is picked up by the wheels or tires of the vehicle 114. A direct rock strike is not as common as a rock strike near an accelerometer 114.

As a result of excitation of the accelerometer 104 by the rock, an artifact is produced in the vehicle cabin 102. An artifact is an undesired noise, such as a popping sound. The artifact is caused when the accelerometer 104 is excited (or otherwise detects the disturbance caused by the rock) and generates a noise signal 112 in response. The noise signal 112 is transmitted to the controller 110 where it is interpreted as a change in road noise instead of the impulsive event of the rock strike. In response, the controller 110 generates a noise-cancellation signal 118 in response to the noise signal 112. As the noise signal 112 was based on an impulsive event (e.g., rock strike) instead of a change in road noise, the noise-cancellation signal 118 is stronger than required. Thus, the residual noise (i.e., difference between the noise-cancellation signal 118 and the noise signal 112) is greater than necessary and is detected by the reference sensor 106.

Ultimately, the reference sensor 106 generates a higher (or greater) error signal (i.e., reference sensor signal 120), which is used to generate a filter update signal 126 for adjusting or otherwise updating the filter coefficients implemented in filter $W_{ADAPT}$ 122. Thus, the noise-cancellation system 100 overreacts to the impulsive event (e.g., rock strike) and the resulting change to the filter coefficients requires additional adjustment and adaptation to return to correct, reasonable levels to reduce or eliminate actual road noise. To correct the overreaction of the accelerometers 104, an impulsive events turn-off can be utilized.

As described above, artifacts are not caused by a true vibration detected at an accelerometer 104. Thus, the artifact can be reduced or eliminated as compared to a true vibration, such as a vibration caused by a pot hole, which will correspond to noise in the vehicle cabin 102. For example, when a vehicle 114 hits a pot hole, the vibration (approximately 1 G) will correspond to the noise in the cabin, while a rock striking the vehicle 114 (approximately 4-5 G) will not correspond to cabin noise.

One method for reducing or eliminating the overreaction caused by the road debris is an impulsive events turn-off utilizing a level detector 128 at the controller 110. As shown in FIG. 2, the level detector 128 is a component of the controller 110, upstream from the adaptive processing module 124 and adaptive filter 122. The level detector 128 receives, as an input, the noise signal 112 from the accelerometer 104 (in FIG. 2). The level detector 128 then takes the absolute value of the derivative of the acceleration (i.e., jerk) of the output 112 (used interchangeably with noise signal 112) of the accelerometer 104 prior to saturation and compares it to a threshold value. In an embodiment, the threshold value is tuned for each particular accelerometer 104 on the vehicle 114. In another embodiment, the threshold value is tuned for each axis of each accelerometer 104. Using the absolute value of the derivative of the acceleration is based on the inference that the accelerometer 104 is about to saturate and the noise-cancellation system 100 can thus wait for the impulsive event (e.g., rock strike) to dissipate.

The impulsive events turn-off can be executed in a number of ways. In one embodiment, if the absolute value of the derivative of the acceleration (or any other output 112 of the accelerometer 104) meets or exceeds the threshold, the noise-cancellation system 100 (via the controller 110) forces the output 112 from the accelerometer 104 to a zero value. Thus, the output 112 of the accelerometer 104, set to a zero value, is transmitted to the adaptive processing module 124. The adaptive processing module 124, which generates a filter update signal 126, sets its output (filter update signal 126) to a zero value as well. Upon receiving the threshold detection (i.e., data indicating that the absolute value meets or exceeds the threshold), the adaptive filter 122 halts adaptation of the filter coefficients. Conversely, if the absolute value is below the threshold, the level detector 128 transmits the noise signal 112 to the adaptive processing module 124 for the generation of a filter update signal 126 and adaptation of the filter coefficients at the adaptive filter 122.

In another embodiment, the output (noise signal 112) from the particular accelerometer 104 sensing the impulsive event (e.g., rock strike) is ignored when the level detector 128 determines that the absolute value of the derivative of the acceleration (or any other output 112 of the accelerometer 104) meets or exceeds the threshold value. In other words, when the level detector 128 receives a noise signal 112 from the particular accelerometer 104 sensing the impulsive event (e.g., rock strike), the level detector 128 ignores the noise signal 112. In turn, the adaptive processing module 124 does not generate a filter update signal 126, thereby ignoring the impulsive event as well. In a similar embodiment, only the output (noise signal 112) from one particular axis of an accelerometer 104 is ignored in the method described above.

In an alternative embodiment, when an accelerometer 104 reaches a threshold level of saturation, determined by the level detector 128, the output (noise signal 112) of the level detector 128 is adjusted to a zero value. For example, the noise-cancellation system 100 running with a sample rate of 2 Khz will adjust to a zero input at the adaptive processing module 124 for 10-20 milliseconds, the duration of the artifact. Alternatively, the method for reducing or eliminating the artifact in the vehicle cabin 102 can incorporate any combination of the embodiments recited above.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive examples described herein. It is, therefore, to be understood that the foregoing examples are presented by way of example only and that, within the scope of the appended claims and equivalents thereto, inventive examples may be practiced otherwise than as specifically described and claimed. Inventive examples of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

The invention claimed is:

1. A noise-cancellation system, comprising:

an accelerometer arranged and configured to detect acceleration indicative of a disturbance, wherein the accelerometer is also arranged and configured to generate a noise signal indicative of the disturbance when an absolute value of a derivative of the acceleration exceeds a threshold value;

a controller arranged and configured to generate a noise-cancellation signal and transmit the noise-cancellation signal to a speaker, which transduces the noise-cancellation signal to acoustic energy;

a level detector arranged and configured to receive the noise signal, calculate the absolute value of the derivative of the acceleration indicative of the disturbance from the noise signal, determine if the absolute value exceeds the threshold value, and set the noise signal to a zero value if the absolute value exceeds the threshold value;

a reference sensor arranged and configured to detect residual noise resulting from the combination of the acoustic energy of the noise-cancellation signal and the disturbance, and to generate a reference sensor signal based on the detection of residual noise;

an adaptive processing module configured to receive the reference sensor signal and the noise signal, and generate a filter update signal, wherein the filter update signal is set to a zero value if the absolute value exceeds the threshold value; and an adaptive filter having one or more filter coefficients, the adaptive filter configured to receive the filter update signal and adjust the one or more filter coefficients based on the filter update signal if the filter update signal exceeds a zero value.

2. The noise-cancellation system of claim 1, wherein the noise signal is not transmitted from the level detector to the adaptive processing module when the absolute value of the derivative of the acceleration exceeds the threshold value.

3. The noise-cancellation system of claim 1, further comprising a first axis, a second axis, and a third axis of the accelerometer.

4. The noise-cancellation system of claim 3, wherein the level detector is arranged and configured to calculate the absolute value of the derivative of the acceleration indicative of the disturbance for each of the first axis, second axis, and third axis and determine if the absolute value exceeds the threshold value for each of the first axis, second axis, and third axis.

5. The noise-cancellation system of claim 4, wherein the noise signal is set to a zero value when the absolute value of the derivative of the acceleration of the first axis of the accelerometer exceeds the threshold value.

6. The noise-cancellation system of claim 1, wherein the accelerometer is mounted to a vehicle.

7. The noise-cancellation system of claim 1, wherein the level detector is also arranged and configured to detect a threshold level of saturation of the accelerometer.

8. The noise-cancellation system of claim 7, wherein the noise signal is set to a zero value when saturation of the accelerometer exceeds the threshold level of saturation.

9. One or more non-transitory machine-readable storage devices having encoded thereon computer readable instructions for causing one or more processors to perform operations comprising:

transmitting a noise-cancellation signal to a speaker, wherein the speaker transduces the noise-cancellation signal to acoustic energy;

receiving an acceleration of a structure having a predefined volume;

calculating an absolute value of a derivative of the acceleration;

comparing the absolute value to a threshold value;

adjusting one or more filter coefficients of an adaptive filter when the absolute value does not exceed the threshold value, wherein the one or more filter coefficients of the adaptive filter are used to filter a reference sensor signal based on residual noise, and wherein the residual noise results from the combination of acoustic energy of each of the noise-cancellation signal and an undesired noise in the predefined volume; and preventing adjustment of one or more filter coefficients of the adaptive filter when the absolute value exceeds the threshold value.

10. The one or more machine-readable storage devices of claim 8, further comprising detecting a saturation level of an accelerometer.

11. The one or more machine-readable storage devices of claim 10, further comprising comparing the saturation level of the accelerometer to a threshold level of saturation.

12. The one or more machine-readable storage devices of claim 11, further comprising preventing adjustment of one or more filter coefficients of the adaptive filter when the saturation level of the accelerometer exceeds the threshold level of saturation.

13. The one or more machine-readable storage devices of claim 8, wherein the acceleration includes an acceleration for a first axis, a second axis, and a third axis.

14. The one or more machine-readable storage devices of claim 13, further comprising calculating the absolute value of the derivative of the acceleration for each of the first axis, the second axis, and the third axis.

15. A method for reducing acoustic artifacts in a vehicle cabin, comprising the steps of:

generating a first noise signal representative of a first acceleration detected by an accelerometer of a vehicle caused by a disturbance;

generating a noise-cancellation signal via a controller within the vehicle;

transmitting the noise-cancellation signal to a speaker within the vehicle, wherein the speaker transduces the noise-cancellation signal to acoustic energy emitted into the vehicle cabin;

detecting residual noise via a reference sensor in the vehicle cabin;

wherein the residual noise results from the combination of the acoustic energy of the noise-cancellation signal and the disturbance;

generating a reference sensor signal via the reference sensor based on the residual noise;

receiving the reference sensor signal and the first noise signal at an adaptive processing module of the controller;

generating a filter update signal via the adaptive processing module based on the reference sensor signal and the first noise signal;

adjusting one or more filter coefficients of an adaptive filter of the controller based on the filter update signal;

detecting a second acceleration with the accelerometer;

calculating an absolute value of a derivative of the second acceleration using a level detector at the controller;

comparing, via the level detector, the absolute value to a threshold value; and preventing adjustment of one or more filter coefficients of the adaptive filter of the controller based on the filter update signal when the absolute value exceeds the threshold value.

16. The method of claim 15, further comprising the steps of:

generating a second noise signal representative of the second acceleration; and setting the second noise signal to a zero value when the absolute value exceeds the threshold value.

17. The method of claim 15, further comprising the steps of:

detecting, via the level detector, a saturation level of the accelerometer; and comparing, via the level detector, the saturation level of the accelerometer to a threshold value of saturation.

18. The method of claim 17, further comprising the step of preventing adjustment of one or more filter coefficients of the adaptive filter of the controller based on the filter update signal when the saturation level of the accelerometer exceeds the threshold value of saturation.

19. The method of claim 15, wherein the accelerometer has a plurality of axes.

20. The method of claim 19, wherein the step of detecting a second acceleration with the accelerometer comprises the step of detecting a second acceleration of each of the plurality of axes of the accelerometer.

* * * * *